US005338898A

United States Patent [19]

Luciano et al.

[11] Patent Number: 5,338,898

[45] Date of Patent: Aug. 16, 1994

[54] DEVICE FOR FACILITATING AND PROTECTING THE CONNECTION BETWEEN CONDUCTIVE CABLES AND ASSOCIATED TERMINALS FOR CONNECTION TO ELECTRICAL APPARATUS, PARTICULARLY THE ELECTROMAGNET OF A MOTOR VEHICLE STARTER MOTOR

[75] Inventors: SMO' Luciano; Spina Donato, both of Turin, Italy

[73] Assignee: Fiat Auto S.p.A., Torino, Italy

[21] Appl. No.: 80,090

[22] Filed: Jun. 21, 1993

Related U.S. Application Data

[63] Continuation of Ser. No. 857,169, Mar. 25, 1992, abandoned.

[30] Foreign Application Priority Data

Mar. 26, 1991 [IT] Italy ..... TO91 U 000068

[51] Int. Cl.[5] ..... H01R 13/46

[52] U.S. Cl. ..... 174/138 F; 439/449; 439/521; 439/892; 429/65

[58] Field of Search ..... 174/138 F, 135; 248/56; 439/202, 369, 449, 471, 371, 373, 447, 521, 522, 892; 429/65

[56] References Cited

U.S. PATENT DOCUMENTS

| | | | |
|---|---|---|---|
| 2,052,081 | 8/1936 | Campbell | 439/202 |
| 2,276,818 | 3/1942 | Bellows, Jr. | 174/135 |
| 3,122,386 | 2/1964 | Pearson | 174/135 X |
| 3,633,154 | 1/1972 | Glantz | 439/202 |
| 3,809,798 | 5/1974 | Simon | 174/135 X |
| 4,072,388 | 2/1978 | Dunn | 439/449 X |
| 4,169,643 | 10/1979 | Gallagher | 439/369 |
| 4,288,504 | 9/1981 | Julian et al. | 439/504 X |
| 4,410,226 | 10/1983 | Adduci et al. | 174/138 F X |
| 4,564,255 | 1/1986 | Kirma | 439/471 |
| 4,778,408 | 10/1988 | Morrison | 439/522 |

FOREIGN PATENT DOCUMENTS

| | | | |
|---|---|---|---|
| 1576775 | 8/1969 | France . | |
| 2312866 | 12/1976 | France | 439/521 |

*Primary Examiner*—Leo P. Picard
*Assistant Examiner*—Hyung S. Sough
*Attorney, Agent, or Firm*—Sughrue, Mion, Zinn, Macpeak & Seas

[57] ABSTRACT

A device for facilitating and protecting the connection between conductor cables and associated connection terminals of electrical apparatus, particularly the electromagnet of a motor vehicle starter motor, comprising a box-like body having a base and a cover of electrically insulating material. The base has a seat for form coupling engagement on to the connection terminal and an aperture for the introduction of conductor cables, and the cover is articulated to the base so as to be turnable relative to this between an open position and a closure position. An external retaining member connected to the body is attachable to the cables.

3 Claims, 2 Drawing Sheets

Figure 1:
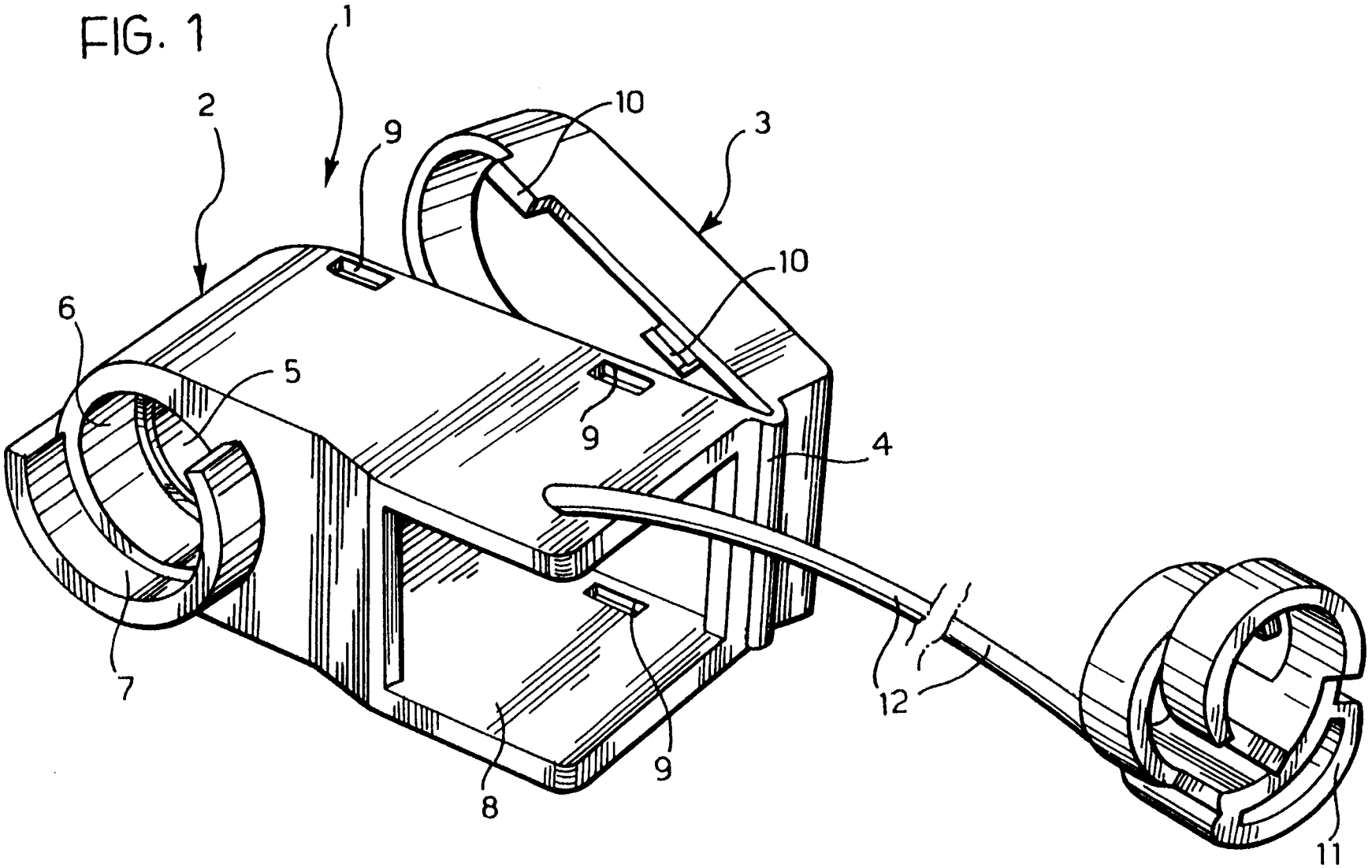

DEVICE FOR FACILITATING AND PROTECTING THE CONNECTION BETWEEN CONDUCTIVE CABLES AND ASSOCIATED TERMINALS FOR CONNECTION TO ELECTRICAL APPARATUS, PARTICULARLY THE ELECTROMAGNET OF A MOTOR VEHICLE STARTER MOTOR

This is a continuation of application Ser. No. 07/857,169 filed Mar. 25, 1992 is now abandoned.

BACKGROUND OF THE INVENTION

The present invention relates in general to the connection between conductive cables and associated terminals for connection to electrical apparatus. More particularly, the invention relates to the connection between the connection terminal of the electromagnet of an electric starter motor for an internal combustion engine of a motor vehicle and the associated supply cables coming from the battery.

On the majority of motor cars currently in production, the position of these cables is left to the discretion of the assembly workers. In some cases the positioning is obtained by the use of metal brackets preliminarily fixed to the starter motor, with consequent variations of the connector terminal. The electrical insulation of the connection between the terminal and the cables is achieved by the use of rubber caps of various shape and dimensions.

An incorrect positioning of the cables can cause various disadvantages, the most serious of which is the risk of fire if the vehicle is involved in an accident, even at low speed. Moreover, the insulating caps, because of their weakness or because of incorrect assembly, are often not able to ensure the necessary protection of the connection.

To ensure positioning of the cables in an unequivocal manner it has until now been necessary to use a range of connection terminals for starter motors, with evident problems and labor in production. This further involves a corresponding range of variation of the protective caps and the risk of erroneous use of one given type of cap of unsuitable shape for the connection terminal to which it is fitted.

SUMMARY OF THE INVENTION

The object of the present invention is that of overcoming these disadvantages and of providing a device which makes the connection between the cables and the associated electrical apparatus easier, requiring the operator to orientate and position the cables exclusively in the connection configuration established by the design, and on the other hand guarantees a more effective electrically insulating protection of the connection.

According to the invention, this object is achieved by means of a device characterised by the fact that it comprises a box-like body having a base and a cover of electrically insulating material, the base having a seat for engagement by form coupling on the connection terminal of the electrical apparatus and an aperture for the introduction of the conductor cables, and the cover being articulated to the base so as to be turnable relative to this between an open position and a closed position, and an external retaining member connected to the body and attachable to the said cables.

Thanks to this arrangement, the operation of connecting the conductor cables to the connection terminal, disposing these cables in the correct orientation and lay out, is made easier and more convenient. It is, in fact, sufficient to position the base of the body on the terminal in the envisaged orientation and then engage the seat of the base itself on to the terminal, maintaining the cover in the open position. The connection ends of the conductor cables attached to the body of the device by means of the external retaining member, are then inserted through the aperture in the base and fixed in a conventional manner to the terminal by acting in the space left open by the cover. Finally, closure of the cover takes place. This cover forms an effective and stable insulating protection for the connection.

The device allows a significant standardization of connection terminals for electrical apparatus which is particularly advantageous in the specific application to motor vehicle starter motors, and makes it possible for the currently used insulating cap to be dispensed with.

In a preferred embodiment of the invention, the cover and base of the body are formed integrally of molded plastics material and are connected together by means of a ligament hinge, and there are further provided integral hook and snap-engagement means between the base and the cover for the closure of this latter.

Figure 2:
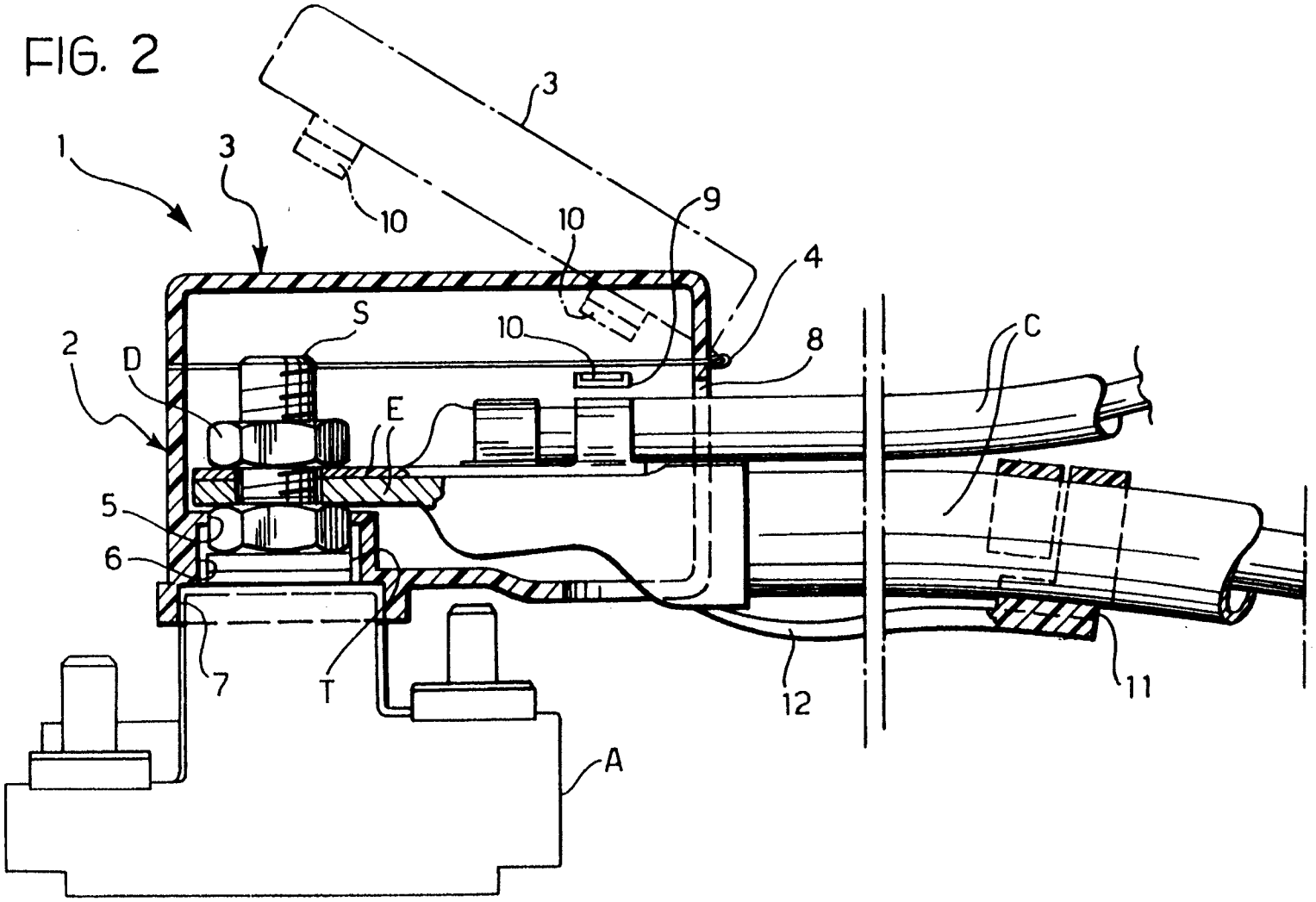

The seat of the base, which is normally shaped in such a way as to be forced fitted on to the connection terminal of the electrical apparatus, conveniently has associated therewith an abutment for angularly centering the device relative to the terminal. The invention will now be described in detail with reference to the attached drawings, provided purely by way of non-limitative example in which:

FIG. 1 is a schematic perspective view of a device according to the invention, and FIG. 2 is a sectional view of the device shown in use.

In the drawings, the reference numeral 1 generally indicates a molded plastics material body constituted by a base 2 and a cover 3 connected together at one end by means of an integral ligament hinge 4. The hinge allows the cover 3 to turn in relation to the base 2 between an open position shown in FIG. 1 and in broken outline in FIG. 2, and a closure position shown in solid outline in FIG. 2.

Base 2 has, on the side opposite the cover 3, a through hole 5 delimited by an annular seat 6 externally of which is associated a projection 7 of pre-determined angular extent, the function of which will be clarified hereinbelow.

The base 2 further has an aperture 8 at the end adjacent to the ligament hinge 4 and is formed, close to its edge opposite the seat 6, with a series of counterposed openings 9. These openings are intended to be snap-engaged by a series of corresponding hook projections 10 formed on the edges of the cover 3 when this is turned from the open position to the closure position relative to the base 2.

The reference numeral 11 indicates a resilient band element or the like connected to one side of the base 2 through an elongate element 12 which can be constituted by a rigid rod or by a flexible cable.

In use the body 1 makes the connection between the conductive cables C and a connection terminal T of an electrical apparatus A easier, and makes the protection of this connection more effective. In the specific example illustrated, the apparatus A is constituted by the electromagnet of an electric starter motor for an internal combustion engine of a motor vehicle, and the cables C constitute the supply conductors from the battery (not illustrated) of the vehicle. The terminal T is constituted, in a manner known per se by a cylindrical or prismatic projection from which projects a threaded stem S intended to receive the connection end or terminal E of the cable C to allow their subsequent locking by means of a nut D.

Assembly is performed as follows.

The body 1 is normally attached to one or both cables C by means of the band element 11, which surrounds them in a slidable manner. In this way, at a pre-assembly station to each set of cables C for a given type of vehicle, there is preliminarily associated an appropriate body 1, (suited to the shape of the hole 5, the seat 6, the associated outer projection 7, and/or the arrangement of the aperture 8) for application to a specific terminal T, or rather to a plurality of joined terminals T.

The first operation consists in fitting the seat 6 of the base 2 on to the terminal T whilst maintaining the cover 3 in the open position, and orientating it according to the pre-established layout position. This operation is facilitated thanks to the interaction between the terminal T and the outer projection 7 which functions in this way as an angular centering abutment of the body 1.

The base 2 is then clamped in relation to the terminal T to effect form coupling, either forcibly or by snap engagement between the seat 6 and the terminal itself. In this way the screw S is enclosed within the base 2 through the hole 5.

The subsequent operation consists in introducing the terminals E of the cables C into the base 2 through the aperture 8 by means of a sliding movement of these cables C relative to the attachment band 11. The terminals E are fitted on to the screw S and then clamped to the terminal T by means of the nut D.

Finally the cover 3 is closed and locked in relation to the base 2 by the snap engagement of the projections 10 into the associated openings 9.

At the end of assembly the connection between the cables C and the terminals T is effected in the correct predetermined layout position, and the insulating protection of this connection is ensured in an effective and stable manner.

Naturally the ambit of the present invention extends to embodiments which achieve the same ends by utilizing the same inventive concept. Thus, for example, the base 2 and the cover 3 could be constituted by two separate, distinct parts, and in this case the ligament hinge 4 would be replaced by a simple flexible connection member similar to the element 12.

What is claimed is:

1. A system for facilitating connection of at least one conductive cable with an associated connection terminal of an electrical apparatus comprising a device for facilitating the connection in combination with said terminal;

said device comprising a box-like body having a base and a cover of electrically insulating material, said base having a seat defining an opening through which the terminal extends with the terminal engaging the seat with a force fit, an aperture for the introduction of said at least one conductive cable and an integral centering abutment projecting exteriorly from said body and extending partially around said opening for centering the body angularly relative to the connecting terminal;

said terminal being shaped so as to be engaged with form coupling by the integral centering abutment of said body, whereby in the engaged condition of said body with said terminal the aperture for receiving said at least one conductive cable has a predetermined angular orientation relative to the terminal;

means hingedly connecting said cover to said base so as to be turnable relative to said base between an open position and a closed position; and an external retaining member connected to said body and attachable to said at least one cable.

2. A system as set forth in claim 1 wherein said base and said cover are formed integrally of molded plastic material and are connected together by means of a ligament hinge and wherein integral snap engagement means are molded for engagement between said base and said cover in the closed position of said cover.

3. A system as set forth in claim 1 wherein said external retaining member is formed by a resilient band member connected to said base of said body by an elongate element.

* * * * *